US009303393B2

(12) United States Patent
Bush

(10) Patent No.: US 9,303,393 B2
(45) Date of Patent: Apr. 5, 2016

(54) DOUBLE-ACTING TAMPER-RESISTANT AERATOR AND AERATOR SYSTEM

(71) Applicant: SDB IP Holdings, LLC, Oviedo, FL (US)

(72) Inventor: Shawn D. Bush, Orlando, FL (US)

(73) Assignee: SDB IP Holdings, LLC, Oviedo, FL (US)

( * ) Notice: Subject to any disclaimer, the term of this patent is extended or adjusted under 35 U.S.C. 154(b) by 112 days.

(21) Appl. No.: 14/208,962

(22) Filed: Mar. 13, 2014

(65) Prior Publication Data

US 2014/0263753 A1 Sep. 18, 2014

Related U.S. Application Data

(60) Provisional application No. 61/787,162, filed on Mar. 15, 2013.

(51) Int. Cl.

| | |
|---|---|
| ***E03C 1/084*** | (2006.01) |
| ***B25B 13/02*** | (2006.01) |
| ***B25B 13/48*** | (2006.01) |

(52) U.S. Cl.

CPC ..... *E03C 1/084* (2013.01); *B25B 13/02* (2013.01); *B25B 13/485* (2013.01)

(58) Field of Classification Search

CPC ..... E03C 1/08; E03C 1/084; E03C 1/086; B05B 7/0425

USPC ..... 239/428.5, 462, 590

See application file for complete search history.

(56) References Cited

U.S. PATENT DOCUMENTS

| | | | | |
|---|---|---|---|---|
| 2,986,341 | A * | 5/1961 | Goodrie | E03C 1/084 239/428.5 |
| 2,989,249 | A * | 6/1961 | Richter | E03C 1/084 239/427 |
| 3,014,667 | A * | 12/1961 | McLean | B05B 1/3006 239/428.5 |
| 3,104,827 | A * | 9/1963 | Aghnides | E03C 1/084 239/428.5 |
| 4,534,513 | A * | 8/1985 | Aghnides | E03C 1/084 239/428.5 |
| 6,257,099 | B1 | 7/2001 | Rosenbaum | |
| 6,513,731 | B2 | 2/2003 | Griffin et al. | |
| 2004/0074992 | A1* | 4/2004 | Fleischmann | E03C 1/084 239/428.5 |
| 2009/0007977 | A1* | 1/2009 | Wildfang | E03C 1/08 137/801 |
| 2009/0293684 | A1 | 12/2009 | Hughett et al. | |
| 2010/0065661 | A1* | 3/2010 | Grether | E03C 1/084 239/428.5 |
| 2011/0139283 | A1 | 6/2011 | Stein et al. | |

* cited by examiner

*Primary Examiner* — Len Tran
*Assistant Examiner* — Cody Lieuwen
(74) *Attorney, Agent, or Firm* — The Webb Law Firm

(57) ABSTRACT

A tamper-resistant aerator including an aerator cartridge, an insert defining at least one removal slot, and a locking ring defining at least one removal slot at least partially disposed within a housing is disclosed. The locking ring rotates with respect to the housing to allow alignment of the removal slot of the locking ring with the removal slot of the insert. Alignment of the slots form a continuous passageway through the locking ring and into the insert. Alternatively, a plurality of removal slots may be provided. A mating engagement between the locking ring and the housing secures the locking ring within the housing while still allowing it to rotate with respect to the housing. An aerator system is also provided comprising an aerator as described above and a tool adapted to be received in the continuous passageway formed by the alignment of the slots and engage the insert.

6 Claims, 3 Drawing Sheets

DOUBLE-ACTING TAMPER-RESISTANT AERATOR AND AERATOR SYSTEM

CROSS-REFERENCE TO RELATED APPLICATION

The present application claims priority to U.S. Provisional Patent Application No. 61/787,162, filed Mar. 15, 2013, entitled "Double-Acting Tamper-Resistant Aerator and Aerator System", the entire disclosure of which is hereby incorporated by reference.

BACKGROUND OF THE INVENTION

1. Field of the Invention

The present invention relates to a tamper-resistant aerator and a tamper-resistant aerator system for use on a faucet. More specifically, the invention is directed to an aerator having a rotatable locking ring that increases the difficulty of unauthorized removal of the aerator from the faucet and an aerator system that also includes a tool adapted for installation and removal of the aerator.

2. Description of Related Art

Prior art tamper-resistant aerators require a special tool very similar to a spanner style wrench to remove the aerator from a faucet. The removal tool typically has two prongs on the end that correspond to small slots on the aerator itself. Once these prongs are inserted into the slots on the aerator, the tool is used to unscrew the aerator from the faucet. However, makeshift tools can be fashioned out of many different objects to recreate the abilities of the special tool giving an unauthorized user full ability to remove the tamper-resistant aerator from the faucet. This is a particular issue in the case of public restrooms and the like where the aerators can be easily stolen using such a makeshift tool.

SUMMARY OF THE INVENTION

In accordance with an embodiment of the present invention, a tamper-resistant aerator includes a housing, an aerator at least partially disposed within the housing, an insert engaged with a portion of the housing, with the insert defining at least one removal slot adapted to receive at least a portion of a tool, and a locking ring at least partially disposed within the housing. The locking ring defines at least one removal slot adapted to receive at least a portion of the tool, with the locking ring rotatable relative to the housing. The locking ring is rotatable to align the at least one removal slot of the insert with the at least one removal slot of the locking ring.

In certain configurations, the tamper-resistant aerator also includes a mating engagement between the locking ring and the housing, in which the mating engagement is adapted to secure the locking ring within the housing. The mating engagement may include at least one protrusion on an exterior surface of the locking ring and a corresponding indentation on an interior surface of the housing adapted to receive the protrusion. The protrusion may be a circumferential ring around the exterior surface of the locking ring and the indentation may be a circumferential groove in the interior surface of the housing. In certain configurations, the mating engagement is an interference engagement.

In various embodiments, alignment of the at least one removal slot of the locking ring with the at least one removal slot of the insert forms a continuous passageway through a sidewall of the locking ring and at least partially through a sidewall of the insert. The locking ring may have two slots placed on opposite sides of a circumference of the locking ring, and the insert may have two slots placed on opposite sides of a circumference of the insert. An interior surface of the housing may include a protrusion, and an exterior portion of the insert may abut the protrusion, when the insert is secured within the housing by the protrusion and the locking ring.

The aerator may include an aerator cartridge, and the aerator cartridge and the insert may engage each other to secure the aerator cartridge within the housing. The insert may also include an extension projecting into an inner diameter of the insert, with the aerator cartridge including an extension projecting outwardly from an exterior surface of the aerator cartridge that is configured to engage the extension of the insert.

Optionally, the extension on the insert and the extension on the aerator form a ledge. The tamper-resistant aerator may also include a rubber gasket disposed within the insert and resting on a top surface of the aerator cartridge.

In accordance with another embodiment of the present invention, a tamper-resistant aerator system includes a housing, an aerator cartridge at least partially disposed within the housing, an insert at least partially disposed within the housing, the insert defining at least one removal slot adapted to receive a tool, and a locking ring at least partially disposed within the housing. The locking ring defines at least one removal slot adapted to receive a tool. The locking ring is rotatable with respect to the housing to allow alignment of the at least one removal slot of the locking ring with the at least one removal slot of the insert to form a continuous passageway defined at least partially by a sidewall of the locking ring and at least partially defined by a sidewall of the insert. The tamper-resistant aerator system also includes a tool adapted to be received in the continuous passageway formed by the alignment of the at least one removal slot of the locking ring with the at least one removal slot of the insert and engage the insert.

In certain configurations, the tamper-resistant aerator also includes a mating engagement between the locking ring and the housing, in which the mating engagement is adapted to securely hold the locking ring within the housing. The mating engagement may include at least one protrusion on an exterior surface of the locking ring and a corresponding indentation on an interior surface of the housing adapted to receive the protrusion. The protrusion may include a circumferential ring around the exterior surface of the locking ring and the indentation may include a circumferential groove in the interior surface of the housing.

Optionally, the mating engagement is an interference engagement. In a further configuration, the tool includes a handle and at least one elongated extension. The locking ring may include two slots on opposite sides of a circumference of the locking ring, and the insert may have two slots on opposite sides of a circumference of the insert, and the tool may have two elongated extensions. In a further configuration, an interior surface of the housing includes a protrusion, and an exterior portion of the threaded fitting abuts the protrusion, when the insert is secured within the housing by the protrusion and the locking ring.

DETAILED DESCRIPTION OF THE INVENTION

Figure 1:
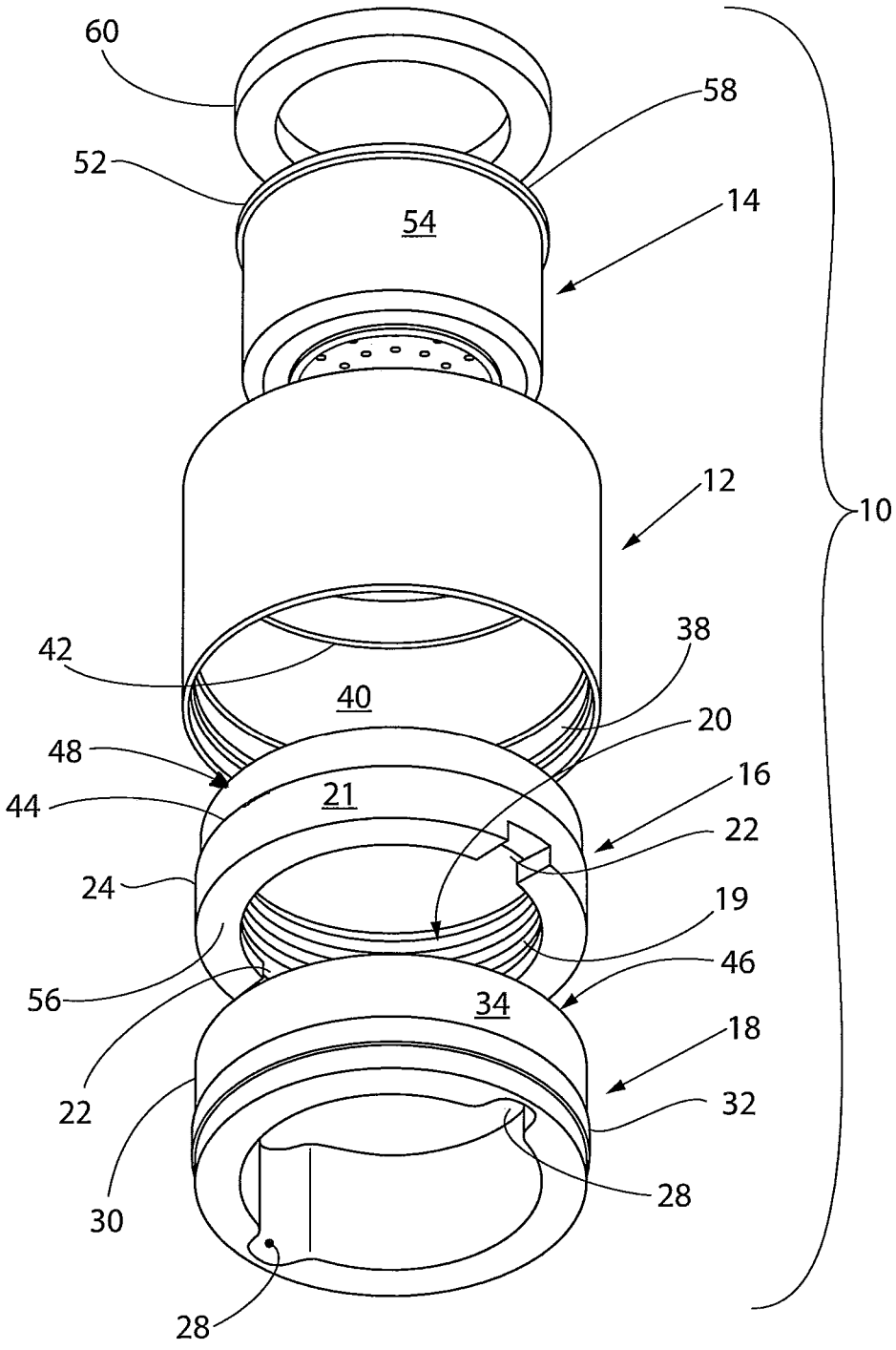
FIG. 1 is an exploded perspective view of the components of one embodiment of the aerator.
Figure 2:
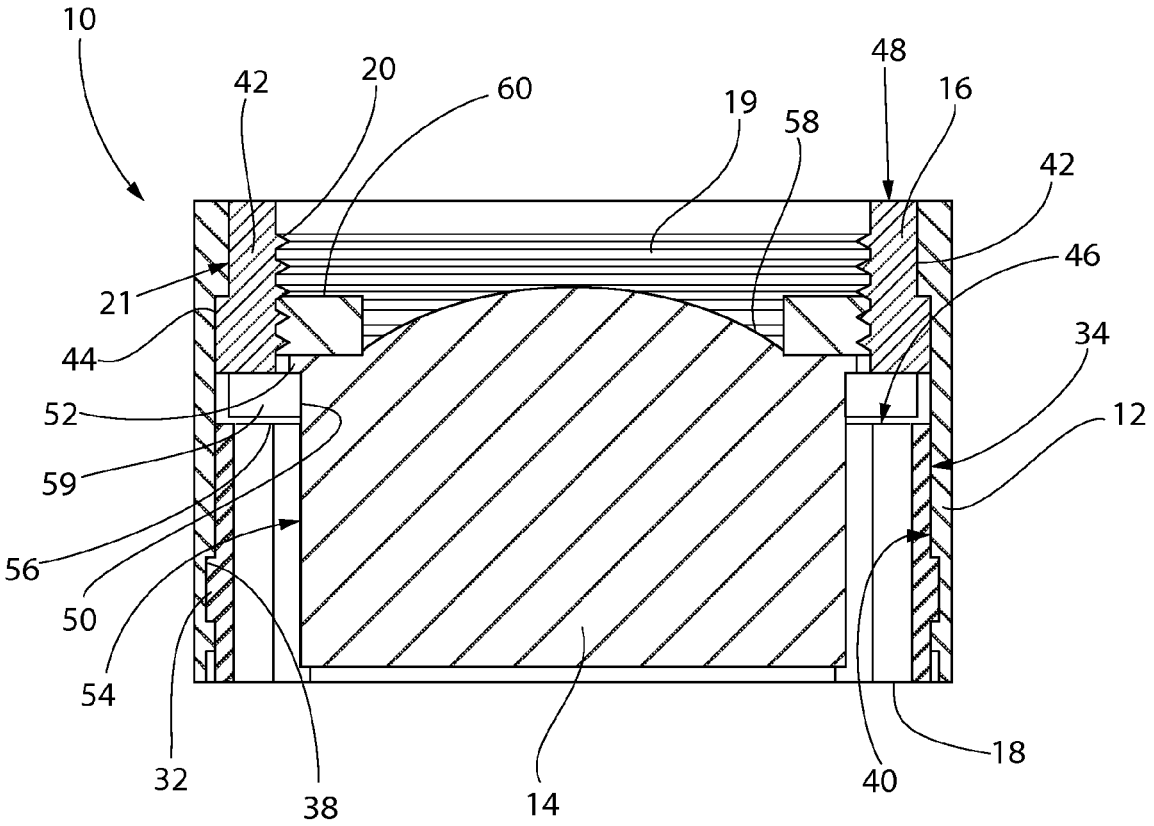
FIG. 2 is a cross-sectional side view of one embodiment of the assembled aerator.

As shown in FIGS. 1 and 2, one embodiment of a double-acting tamper-resistant aerator 10 includes an external housing 12. An aerator cartridge 14, an insert 16, and a locking ring 18 are at least partially disposed within an inner diameter of the housing 12. The aerator cartridge 14, the insert 16, and the locking ring 18 all have maximum outer diameters that are equal to or less than the inner diameter of the housing 12.

The insert 16 is provided with threads 19 that are used to secure the aerator 10 to the faucet. The threads 19 may be on an interior surface 20 of the insert 16 as shown in FIGS. 1 and 2, or may be on an exterior surface 21 of the insert 16. If the threads 19 are on the interior surface 20 of the insert 16, as shown in FIGS. 1 and 2, the insert 16 may be partially or completely disposed within the housing 12. If the threads 19 are on the exterior surface 21 of the insert 16, only a portion of the insert 16 is disposed within the housing 12 and the portion of the insert 16 having the threads 19 is disposed outside of the housing 12.

The insert 16 also defines at least one removal slot 22. The removal slot 22 extends for a portion of or the entire height of a sidewall 24 of the insert 16 and may extend partially or completely through the thickness of the sidewall 24. In the embodiment shown in FIGS. 1 and 2, the insert 16 has two removal slots 22 that extend for a portion of the height of the sidewall 24 and completely through the thickness of the sidewall 24. If the removal slot 22 extends for the entire height of the sidewall 24, the removal slot 22 may only extend through a portion of the thickness of the sidewall 24. When the insert 16 includes a plurality of removal slots 22, the removal slots 22 may be arranged in any fashion around the circumference of the insert 16. In the embodiment shown in FIG. 1, the two removal slots 22 are arranged on opposite sides of the circumference of the insert 16.

The locking ring 18 defines at least one removal slot 28. The removal slot 28 extends for the entire height of a sidewall 30 of the locking ring 18 and extends partially through the thickness of the sidewall 30, although other suitable configurations for the removal slot 28 may be utilized. In the embodiment shown in FIGS. 1 and 2, the locking ring 18 has two removal slots 28. When the locking ring 18 includes a plurality of removal slots 28, the removal slots 28 may be arranged in any fashion around the circumference of the locking ring 18. In the embodiment shown in FIG. 1, the two removal slots 28 are arranged on opposite sides of the circumference of the locking ring 18.

The removal slots 28 of the locking ring 18 are configured to correspond to the removal slots 22 of the insert 16 such that proper alignment of the locking ring 18 and the insert 16 cause the removal slots 22, 28 to form a continuous passageway defined by the sidewall 30 of the locking ring 18 and at least partially defined by the sidewall 24 of the insert 16.

The locking ring 18 is matingly engaged with the housing 12 such that it is free to rotate within the housing 12 allowing the removal slots 22, 28 to be aligned to form a passageway as described above. Such mating engagement may take any suitable form as long as the locking ring 18 is securely fastened within the housing 12 yet is free to rotate with respect to the housing 12. Such an engagement includes, but is not limited to, at least one protrusion 32 on an exterior surface 34 of the locking ring 18 and a corresponding indentation 38 on an interior surface 40 of the housing 12 adapted to receive the protrusion 32. In the embodiment shown in FIGS. 1 and 2, the protrusion 32 takes the form of a circumferential ring on the exterior surface 34 of the locking ring 18 and the indentation 38 takes the form of a circumferential groove in the interior surface 40 of the housing 12. The protrusion 32 is interference or snap-fit into the indentation 38. This interference fit has sufficient play to allow the locking ring 18 to rotate with respect to the housing 12 while securely hold the locking ring 18 within the housing 12.

The housing 12 may also include a protrusion 42 extending from its interior surface 40. A portion 44 of the insert 16 is configured to abut the protrusion 42 in the housing 12 when the locking ring 18 is matingly engaged with the housing 12. Thus, the insert 16 is securely held within the housing 12 by the protrusion 42 and a top surface 46 of the locking ring 18. In FIGS. 1 and 2, the protrusion 42 is a ledge that extends circumferentially around the interior surface 40 of the housing 12 and the insert 16 has a corresponding portion comprising a circumferential ledge extending around its exterior surface 21. Alternatively, the protrusion 42 could engage a top surface 48 of the insert 16. This engagement may allow for rotation of the insert 16 with respect to the housing 12.

The aerator 10 may also include a mating engagement between the aerator cartridge 14 and the insert 16 adapted to secure the aerator cartridge 14 within the housing 12. The mating engagement may take the form of an extension 50 on the insert 16 projecting into the inner diameter of the insert 16 and an extension 52 projecting outwardly from an exterior surface 54 of the aerator cartridge 14. In the embodiment shown in FIG. 2, the extension 50 on the insert 16 takes the form of a ledge at a bottom 56 of the insert 16 and the extension 52 on the aerator cartridge 14 takes the form of a ledge at a top 58 of the aerator cartridge 14. The extensions 50, 52 cooperate such that the aerator cartridge 14 is held within the housing 12 by the cooperation of the ledges 50, 52 and the end of the faucet when the insert 16 is attached to the faucet.

A bottom portion 59 of the sidewall 24 of the insert 16 has a thickness equal to the thickness of the sidewall 30 of the locking ring 18 and the aerator cartridge 14 has an outer diameter corresponding to the inner diameter of the locking ring 18. This assures that the entirety of the water passing into the aerator 10 from the faucet passes through and not around the aerator cartridge 14.

A rubber gasket 60 may also be provided on top 58 of the aerator cartridge 14 such that the gasket 60 provides a tight fit between the top 58 of the aerator cartridge 14 and the faucet when the aerator 10 is connected to the faucet.

To assemble the aerator 10, the insert 16 is placed into the housing 12 from the bottom. A portion 44 of the insert 16 abuts the protrusion 42 on the interior surface 40 of the housing 12. Next, the locking ring 18 is inserted into the housing 12 from the bottom. As described above, there is an interference between the locking ring 18 and the housing 12 to ensure the locking ring 18 is securely held within the housing 12 after assembly. Once the locking ring 18 has been inserted far enough into the housing 12, the protrusion 32 on the exterior surface 34 of the locking ring 18 engages the indentation 38 holding the locking ring 18 securely within the housing 12 yet allowing it to spin freely with respect to the housing 12. Finally, the aerator cartridge 14 is inserted into the insert 16 from the top of the aerator 10.

Figure 3:
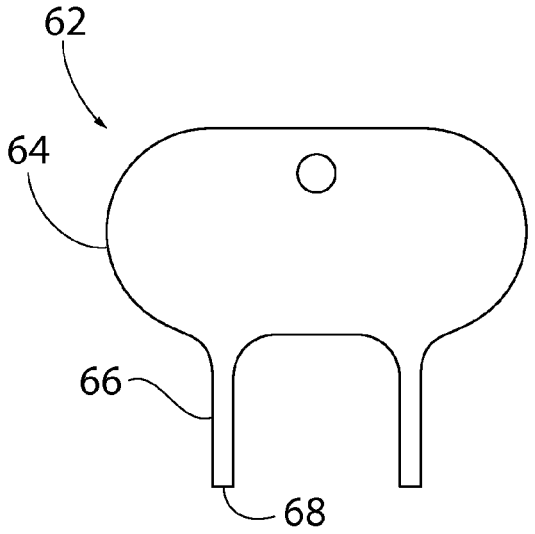
FIG. 3 is a front view of a tool of the aerator system.

The installation and the removal of the aerator 10 from the faucet is accomplished using a tool 62, such as a tool, adapted to be inserted in the passageway(s) created by the alignment of the removal slots 22, 28 of the locking ring 18 and the insert 16. The tool 62 has a handle 64 and at least one elongated extension 66 and may have a number of extensions 66, with the number of extensions 66 corresponding to the number of passageways created by alignment of the locking ring 18 and the insert 16. One embodiment of the tool 62 is shown in FIG. 3. This embodiment has two extensions 66 corresponding to the two passageways created by alignment of the locking ring 18 and the insert 16 shown in FIG. 1. The extensions 66 should have sufficient length to pass through the removal slots 28 in the locking ring 18 and into the removal slots 22 of the insert 16. The extensions 66 are of suitable size and shape to engage the insert 16. Application of torque to the handle 64 of the tool 62 is transferred from a proximal end 68 of the extensions 66 to the insert 16 allowing the aerator 10 to be screwed into the end of the faucet via the threads 19 of the insert 16.

Figure 4:
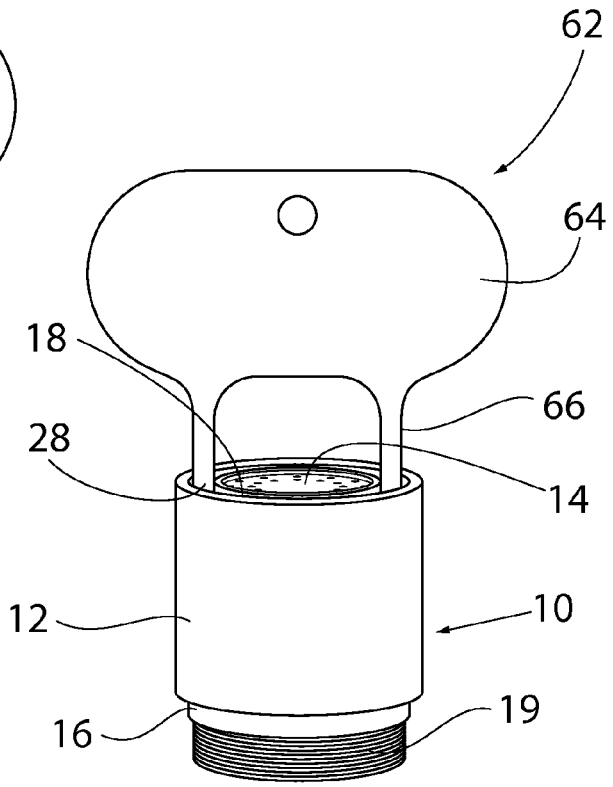
FIG. 4 is a front partial perspective view of the aerator system having a tool engaged therewith in which the removal slots of the locking ring are not aligned with the removal slots of the insert.
Figure 5:
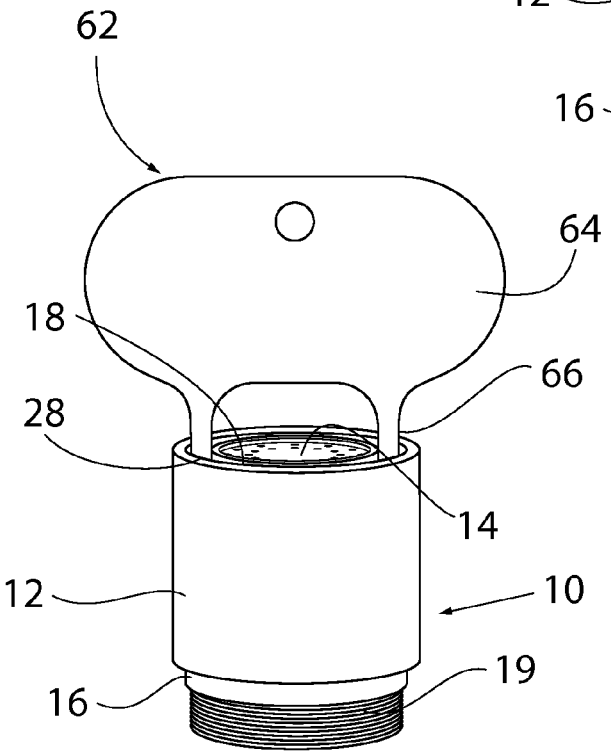
FIG. 5 is a front partial perspective view of the aerator system having a tool engaged therewith in which the removal slots of the locking ring are aligned with the removal slots of the insert.

In use, the extensions 66 on the tool 62 are placed into the removal slots 28 of the locking ring 18. As can be seen in FIG. 4, only a portion of the length of the extensions 66 are received by the removal slots 28 of the locking ring 18. The tool 62 is then turned until the removal slots 28 of the locking ring 18 are aligned with the removal slots 22 of the insert 16. As shown in FIG. 5, upon alignment, the extensions 66 are further received into the aerator 10 and seated in the removal slots 22 of the insert 16. Upon further rotation of the tool 62, the insert 16 is rotated allowing the aerator 10 to be screwed into or unscrewed from the faucet via the threads 19.

The embodiments of the aerator and aerator system as described herein provide two measures to resist removal of the aerator 10 from the faucet by unauthorized persons. Only when removal slots 22, 28 of the locking ring 18 and the insert 16 are aligned can the tool 62 slide fully into the aerator 10 to engage the insert 16 and allow the aerator 10 to be removed from the faucet. A person desiring to tamper with the aerator therefore needs to have a long enough makeshift tool to accomplish removal which makes removal and tampering much more cumbersome. Also, a person desiring to tamper with the aerator 10 will need to have the knowledge that, unlike typical tamper-resistant aerators, the engagement point between the tool 62 and the insert 16 is significantly farther inside the housing 12. Further, a person desiring to tamper with the aerator 10 will need to realize that in order to access the removal slots 22 in the insert 16, the removal slots 28 of the locking ring 18 need to be aligned with the removal slots 22 of the insert 16. All of this additional necessary knowledge and the additional work to find an appropriate makeshift tool further deter tampering with the aerator 10.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of this specification. For example, it is to be understood that the present invention contemplates that, to the extent possible, one or more features of any embodiment can be combined with one or more features of any other embodiment.

The invention claimed is:

1. A tamper-resistant aerator system comprising:

a housing;

an aerator cartridge at least partially disposed within the housing;

an insert at least partially disposed within the housing, the insert defining at least one insert removal slot adapted to receive a tool; and a locking ring at least partially disposed within the housing, the locking ring defining at least one locking ring removal slot adapted to receive a tool, wherein the locking ring is rotatable with respect to the housing to allow alignment of the at least one locking ring removal slot with the at least one insert removal slot to form a continuous passageway defined at least partially by a sidewall of the locking ring and at least partially defined by a sidewall of the insert;

a tool adapted to be received in the continuous passageway formed by the alignment of the at least one locking ring removal slot with the at least one insert removal slot and engage the insert; and a mating engagement between the locking ring and the housing, wherein the mating engagement is adapted to securely hold the locking ring within the housing, and wherein the mating engagement comprises at least one locking ring protrusion on an exterior surface of the locking ring and a corresponding indentation on an interior surface of the housing adapted to receive the at least one locking ring protrusion.

2. The tamper-resistant aerator system of claim 1, wherein the at least one locking ring protrusion comprises a circumferential ring around the exterior surface of the locking ring and the indentation comprises a circumferential groove in the interior surface of the housing.

3. The tamper-resistant aerator system of claim 1, wherein the mating engagement is an interference engagement.

4. The tamper-resistant aerator system of claim 1, wherein the tool comprises a handle and at least one elongated extension.

5. The tamper-resistant aerator system of claim 4, wherein the locking ring has two slots disposed on opposite sides of a circumference of the locking ring, the insert has two slots disposed on opposite sides of a circumference of the insert, and the tool has two elongated extensions.

6. The tamper-resistant aerator system of claim 1, wherein an interior surface of the housing comprises a housing protrusion, and an exterior portion of the insert abuts the housing protrusion when the insert is secured within the housing by the housing protrusion and the locking ring.

* * * * *